US010535316B2

(12) United States Patent
Sim et al.

(10) Patent No.: US 10,535,316 B2
(45) Date of Patent: Jan. 14, 2020

(54) DISPLAY DEVICE HAVING GATE-IN-PANEL CIRCUITS

(71) Applicant: LG DISPLAY CO., LTD., Seoul (KR)

(72) Inventors: JaeHo Sim, Daegu (KR); SangMoo Song, Goyang-si (KR); Byongwook Shin, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 82 days.

(21) Appl. No.: 15/711,049

(22) Filed: Sep. 21, 2017

(65) Prior Publication Data

US 2018/0090091 A1 Mar. 29, 2018

(30) Foreign Application Priority Data

Sep. 29, 2016 (KR) ..... 10-2016-0125366

(51) Int. Cl.

*G09G 3/36* (2006.01)
*G09G 3/3233* (2016.01)
*G09G 3/3266* (2016.01)

(52) U.S. Cl.

CPC ..... *G09G 3/3677* (2013.01); *G09G 3/3233* (2013.01); *G09G 3/3266* (2013.01); *G09G 3/3688* (2013.01); *G09G 3/3696* (2013.01); *G09G 2300/0408* (2013.01); *G09G 2300/0852* (2013.01); *G09G 2300/0861* (2013.01); *G09G 2310/0251* (2013.01); *G09G 2310/0262* (2013.01); *G09G 2330/08* (2013.01)

(58) Field of Classification Search

None

See application file for complete search history.

(56) References Cited

U.S. PATENT DOCUMENTS

| | | | |
|---|---|---|---|
| 2005/0087741 | A1 | 4/2005 | Yamazaki |
| 2006/0017672 | A1 | 1/2006 | Aoki |
| 2006/0103322 | A1 | 5/2006 | Chung et al. |
| 2008/0012797 | A1 | 1/2008 | Kil |
| 2008/0030434 | A1 | 2/2008 | Yamazaki et al. |
| 2008/0036386 | A1 | 2/2008 | Shin et al. |
| 2008/0266210 | A1 | 10/2008 | Nonaka |
| 2010/0289788 | A1 | 11/2010 | Yoshizaki et al. |

(Continued)

FOREIGN PATENT DOCUMENTS

| | | | |
|---|---|---|---|
| CN | 1776794 | A | 5/2006 |
| CN | 101097313 | A | 1/2008 |

(Continued)

OTHER PUBLICATIONS

Office Action dated Aug. 2, 2018, issued in corresponding Japanese Patent Application No. 2017-172572.

(Continued)

*Primary Examiner* — Gustavo Polo

(74) *Attorney, Agent, or Firm* — Morgan, Lewis & Bockius LLP

(57) ABSTRACT

A display device includes a display panel including an active area having a plurality of subpixels and a pad area disposed along the active area; a gate driver in the pad area of the display panel and having a plurality of gate-in-panel circuits; a first signal line outside of the gate driver; a second signal line between the gate driver and the active area; and a plurality of dummy gate-in-panel circuits adjacent to the plurality of gate-in-panel circuits.

18 Claims, 15 Drawing Sheets

(56) References Cited

U.S. PATENT DOCUMENTS

| | | | |
|---|---|---|---|
| 2011/0134104 | A1 | 6/2011 | Yoon et al. |
| 2013/0148049 | A1 | 6/2013 | Abe et al. |
| 2013/0162570 | A1 | 6/2013 | Shin et al. |
| 2015/0123136 | A1* | 5/2015 | Kim ..... G02F 1/13454 257/72 |
| 2015/0130785 | A1 | 5/2015 | Shin et al. |
| 2015/0187810 | A1 | 7/2015 | Lee |
| 2015/0194121 | A1 | 7/2015 | Lee et al. |
| 2015/0243238 | A1 | 8/2015 | Jung et al. |
| 2015/0294985 | A1 | 10/2015 | Hekstra |
| 2015/0340003 | A1 | 11/2015 | Choi |
| 2015/0370370 | A1 | 12/2015 | Ikeda et al. |
| 2015/0380349 | A1 | 12/2015 | Yan |
| 2016/0035284 | A1 | 2/2016 | Jung et al. |
| 2016/0086563 | A1 | 3/2016 | Park et al. |
| 2016/0189664 | A1 | 6/2016 | Lee et al. |
| 2016/0232837 | A1 | 8/2016 | Lee |
| 2016/0351098 | A1 | 12/2016 | Lin et al. |
| 2017/0124977 | A1 | 5/2017 | Suzuki et al. |
| 2017/0221435 | A1 | 8/2017 | Shima |

FOREIGN PATENT DOCUMENTS

| | | | |
|---|---|---|---|
| CN | 102141709 | A | 8/2011 |
| CN | 104090436 | A | 10/2014 |
| CN | 104571758 | A | 4/2015 |
| CN | 104637443 | A | 5/2015 |
| CN | 104637925 | A | 5/2015 |
| CN | 104732908 | A | 6/2015 |
| CN | 104749805 | A | 7/2015 |
| CN | 104867462 | A | 8/2015 |
| CN | 105278783 | A | 1/2016 |
| CN | 105372859 | A | 3/2016 |
| CN | 105469735 | A | 4/2016 |
| CN | 105761670 | A | 7/2016 |
| JP | H07-191349 | A | 7/1995 |
| JP | 2001-013524 | A | 1/2001 |
| JP | 2005-135991 | A | 5/2005 |
| JP | 2006-065284 | A | 3/2006 |
| JP | 2006-349753 | A | 12/2006 |
| JP | 2008-009367 | A | 1/2008 |
| JP | 2008-033253 | A | 2/2008 |
| JP | 2008-292995 | A | 12/2008 |
| JP | 2010-266715 | A | 11/2010 |
| JP | 2013-083679 | A | 5/2013 |
| JP | 2015-203870 | A | 11/2015 |
| JP | 2017-083759 | A | 5/2017 |
| JP | 2017-134338 | A | 8/2017 |
| KR | 10-2016-0017695 | A | 2/2016 |
| TW | 201528244 | A | 7/2015 |

OTHER PUBLICATIONS

Office Action issued in counterpart Taiwanese Patent Application No. 106132213 dated Mar. 14, 2018.

* cited by examiner

DISPLAY DEVICE HAVING GATE-IN-PANEL CIRCUITS

This application claims the benefit of Korean Patent Application No. 10-2016-0125366, filed in Korea on Sep. 29, 2016, which is hereby incorporated by reference for all purposes as if fully set forth herein.

BACKGROUND

Technical Field

The present disclosure relates to a display device.

Discussion of the Related Art

In response to the development of the information society, there has been increasing demand for various types of display devices for displaying images. Recently, a range of display devices, such as liquid crystal display (LCD) devices, plasma display panels (PDPs), and organic light-emitting display devices, have come into widespread use.

Such display devices include a display panel in which data lines and gate lines are disposed and subpixels are defined in areas in which the data lines intersect the gate lines. The display device also includes a data driver supplying data voltages to the data lines, a gate driver driving the gate lines, a controller controlling the driving timing of the data driver and the gate driver, and the like.

A related art gate driver includes separate gate driver integrated circuits (GDICs) respectively having a shift register of the gate driver disposed therein and connecting the GDICs to gate line pads of the display panel using a tape carrier package (TCP) process or the like.

However, recently, gate-in-panel (GIP) technology, for directly providing a shift register of the gate driver on the display panel, has been applied.

According to GIP technology, GIP circuits respectively including thin-film transistors (TFTs) are provided on the display panel, and a plurality of signal lines are disposed on the GIP circuits on the display panel. The signal lines may be formed on a substrate, simultaneously with the gate lines, or simultaneously with the data lines. In addition, the signal lines may be disposed to provide signals to the GIP circuits or to monitor signals output by the GIP circuits.

However, if two or more gate drivers having the GIP structure are disposed on the display panel, when different numbers of signal lines are disposed in the gate driver areas, different amounts of capacitance may be created between the gate drivers, thereby degrading image quality.

In addition, with rounded display panels as currently fabricated, signal lines disposed in the pad areas of the display panel are imparted with a stepped shape to have a rounded structure. However, the stepped shape of the signal lines may increase the distance of the signal lines to the GIP circuits of the gate driver, which have been disposed close thereto, thereby causing transistors of the GIP circuits to deteriorate.

SUMMARY

Accordingly, embodiments of the present disclosure are directed to a display device that substantially obviates one or more of the problems due to limitations and disadvantages of the related art.

An aspect of the present disclosure is to provide a display device in which dummy gate-in-panel (GIP) circuits are disposed between signal lines and GIP circuits on a rounded display panel, thereby preventing the GIP circuits from deteriorating.

Another aspect of the present disclosure is to provide a display device in which the same signal lines are disposed in gate driver areas on both sides of an active area of a display panel, thereby minimizing variations in signals output by gate drivers and reducing or removing defects in quality.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises a display panel including an active area having a plurality of subpixels and a pad area disposed along the active area; a gate driver in the pad area of the display panel and having a plurality of gate-in-panel circuits; a first signal line outside of the gate driver; a second signal line between the gate driver and the active area; and a plurality of dummy gate-in-panel circuits adjacent to the plurality of gate-in-panel circuits.

In another aspect, a display device comprises a display panel including an active area having a plurality of subpixels and a pad area disposed along the active area; a first gate driver and a second gate driver disposed in the pad area respectively located at opposing sides relative to the active area; a first signal line group including one or more signal lines disposed in an area of the first gate driver; and a second signal line group including one or more signal lines disposed in an area of the second gate driver, wherein a number of the signal lines of the first signal line group is equal to a number of the signal lines of the second signal line group.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
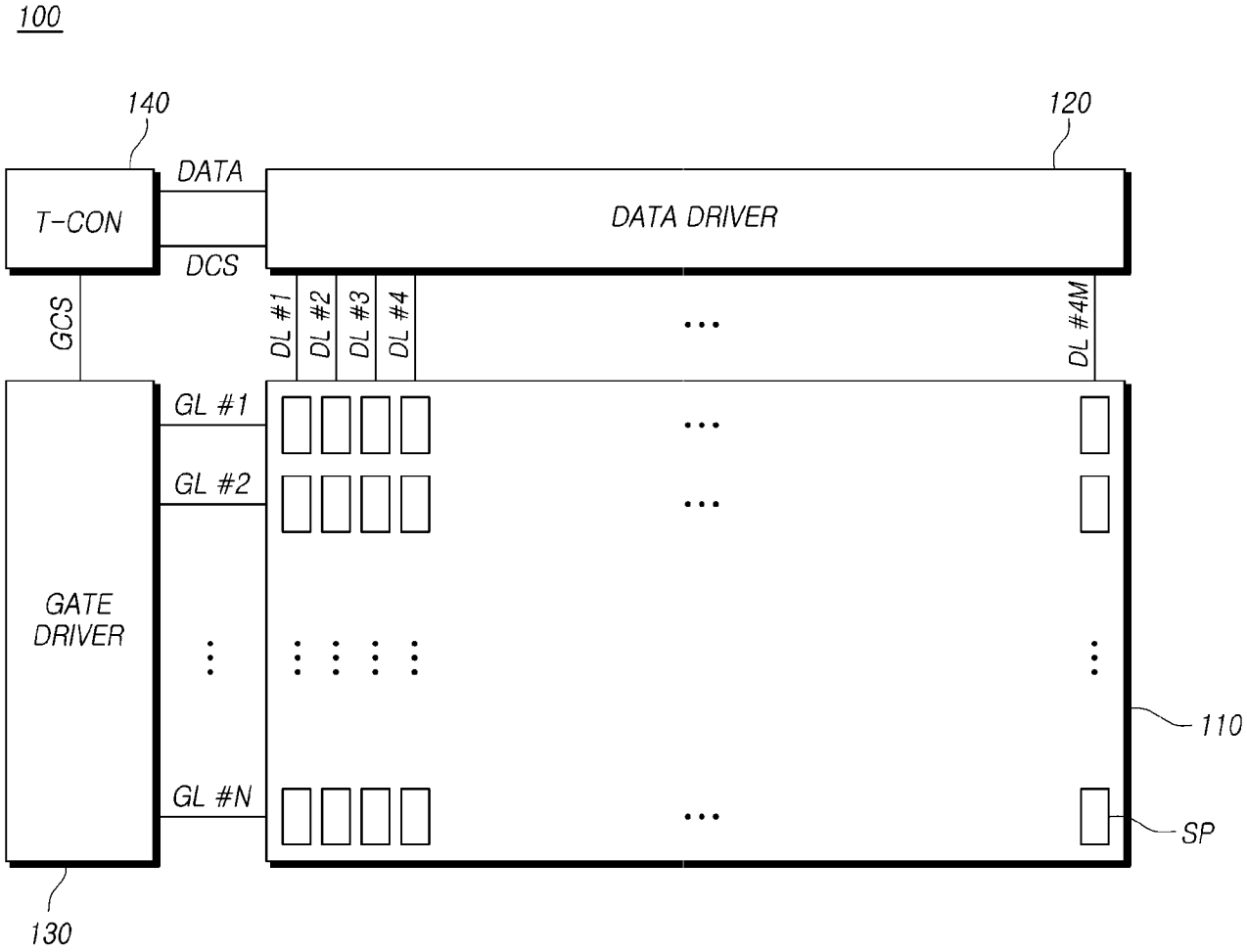
FIG. 1 is a schematic view illustrating a system configuration of an organic light-emitting display device according to exemplary embodiments.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in many different forms. Rather, these embodiments are provided so that the present disclosure will be thorough and complete, and will fully convey the scope of the present disclosure to a person skilled in the art. The scope of the present disclosure shall be defined by the appended claims.

The shapes, sizes, ratios, angles, numbers, and the like, inscribed in the drawings to illustrate exemplary embodiments are illustrative only, and the present disclosure is not limited to the embodiments illustrated in the drawings. Throughout this document, the same reference numerals and symbols will be used to designate the same or like components. In the following description of the present disclosure, detailed descriptions of known functions and components incorporated herein will be omitted in the case that the subject matter of the present disclosure may be rendered unclear thereby.

It should be understood that the terms "comprise," "include," "have," and any variations thereof used herein are intended to cover non-exclusive inclusions unless explicitly described to the contrary. Descriptions of components in the singular form are intended to include descriptions of components in the plural form, unless explicitly described to the contrary.

In the analysis of a component, it shall be understood that an error range is included therein, even in the case in which there is no explicit description thereof.

When spatially relative terms, such as "on," "above," "under," "below," and "on a side of," are used herein for descriptions of relationships between one element or component and another element or component, one or more intervening elements or components may be present between the one and another elements or components, unless a term, such as "directly," is used.

When temporally relative terms, such as "after," "subsequent," "following," and "before" are used to define a temporal relationship, a non-continuous case may be included unless the term "directly" is used.

In addition, terms, such as "first" and "second" may be used herein to describe a variety of components. It should be understood, however, that these components are not limited by these terms. These terms are merely used to discriminate one element or component from another element or component. Thus, a first element referred to as first hereinafter may be a second element within the spirit of the present disclosure.

The features of exemplary embodiments of the present disclosure may be partially or entirely coupled or combined with each other and may work in concert with each other or may operate in a variety of technical methods. In addition, respective exemplary embodiments may be carried out independently or may be associated with and carried out in concert with other embodiments.

Hereinafter, exemplary embodiments will be described in detail with reference to the drawings. In the drawings, the size, thickness, and the like of the device may be exaggerated for the sake of clarity. Throughout this document, the same reference numerals and symbols will be used to designate the same or like components.

Figure 2:
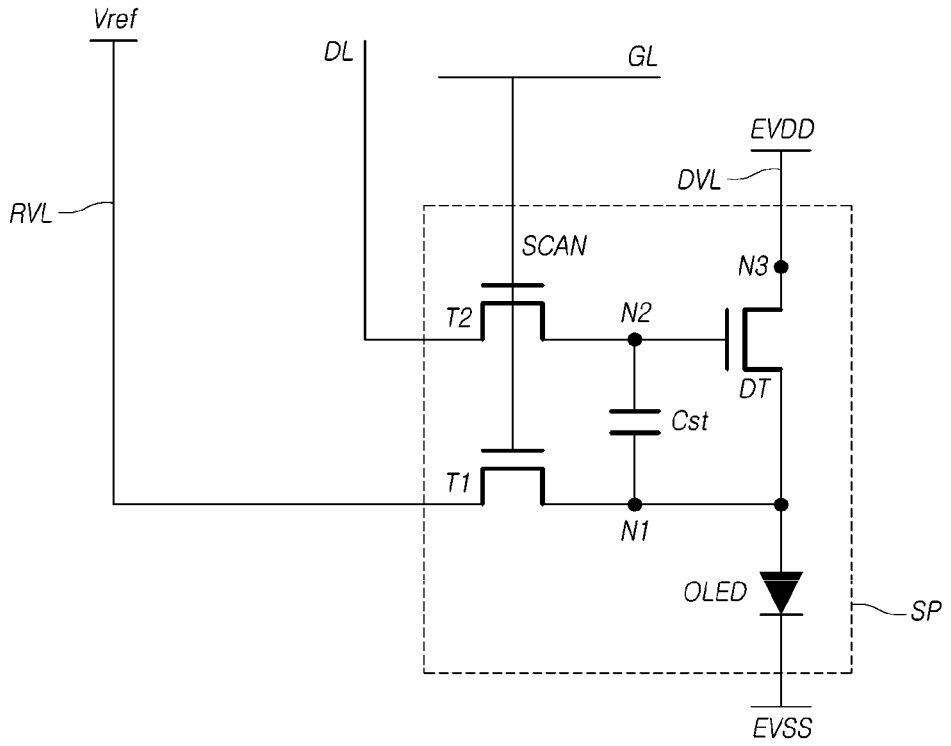
FIG. 2 is an equivalent circuit diagram of a subpixel of the organic light-emitting display device according to exemplary embodiments.

FIG. 1 is a schematic view illustrating a system configuration of an organic light-emitting display device according to exemplary embodiments, and FIG. 2 is an equivalent circuit diagram of a subpixel of the organic light-emitting display device according to exemplary embodiments.

With reference to FIGS. 1 and 2, an organic light-emitting display device 100 according to exemplary embodiments includes a display panel 110, a data driver 120, a gate driver 130, and a controller (T-CON) 140. The display panel 110 has a plurality of data lines DL #1, DL #2, . . . , and DL #4M (where M is an integer equal to or greater than 1) arranged in a first direction (e.g., a row direction), a plurality of gate lines GL #1, GL #2, . . . , and GL #N (where N is an integer equal to or greater than 1) arranged in a second direction (e.g., a column direction), and a plurality of subpixels SP arranged in a matrix. The data driver 120 drives the plurality of data lines DL #1, DL #2, . . . , and DL #4M. The gate driver 130 drives the plurality of gate lines GL #1, GL #2, . . . , and GL #N. The controller 140 controls the data driver 120 and the gate driver 130.

The data driver 120 drives the plurality of data lines DL #1, DL #2, . . . , and DL #4M by providing data voltages to the plurality of data lines DL #1, DL #2, . . . , and DL #4M.

The gate driver 130 sequentially drives the plurality of gate lines GL #1, GL #2, . . . , and GL #N by sequentially providing a scanning signal to the plurality of gate lines GL #1, GL #2, . . . , and GL #N.

The controller 140 controls the data driver 120 and the gate driver 130 by providing a variety of control signals to the data driver 120 and the gate driver 130. The controller 140 starts scanning based on timing realized in each frame, converts image data input from an external source into a data signal format readable by the data driver 120 before outputting the converted image data, and regulates data processing at a suitable point in time in response to the scanning.

The gate driver 130 drives the plurality of gate lines GL #1, GL #2, . . . , and GL #N by sequentially providing a scanning signal having an on or off voltage to the plurality of gate lines GL #1, GL #2, . . . , and GL #N, under the control of the controller 140. The gate driver 130 may be located on one side of the display panel 110, as illustrated in FIG. 1, or in some cases, on both sides of the display panel 110, depending on the driving system or the like. In addition, the gate driver 130 may include one or more gate driver integrated circuits (GDICs), hereinafter referred to as "gate in panel (GIP) circuits." Each of the GIP circuits may be connected to a bonding pad of the display panel 110 by tape-automated bonding (TAB) or a chip-on-glass (COG) method and may be implemented as a gate-in-panel (GIP)

type, which is directly disposed on the display panel 110, or in some cases, may be integrated with the display panel 110. Each of the GIP circuits may include a shift register, a level shifter, and the like.

When a specific gate line is opened, the data driver 120 drives the plurality of data lines DL #1, DL #2, . . . , and DL #4M by converting the image data DATA, received from the controller 140, to analog data voltages and then providing the analog data voltages to the plurality of data lines DL #1, DL #2, . . . , and DL #4M. The data driver 120 may include one or more source driver integrated circuits (SDICs) to drive the plurality of data lines DL #1, DL #2, . . . , and DL #4M. Each of the SDICs may be connected to a bonding pad of the display panel 110 by tape-automated bonding (TAB) or a chip-on-glass (COG) method and may be directly disposed on the display panel 110, or in some cases, may be integrated with the display panel 110. Each of the SDICs may include a logic circuit, a digital-to-analog converter (DAC), an output buffer, or the like. The logic circuit may include a shift register, a latch circuit, or the like. In some cases, each of the SDICs may further include a sensing circuit for sensing characteristics (e.g., the threshold voltage and mobility of a driving transistor, the threshold voltage of an organic light-emitting diode (OLED), the luminance of a subpixel, and the like) of a subpixel to compensate for the characteristics of the subpixel. Each of the SDICs may be implemented as a chip-on-film (COF) SDIC. In this case, one end of each SDIC is bonded to one or more source printed circuit boards (SPCBs), and the other end of each SDIC is bonded to the display panel 110.

The controller 140 receives a variety of timing signals, including a vertical synchronization (Vsync) signal, a horizontal synchronization (Hsync) signal, an input data enable (DE) signal, and a clock signal, together with input image data, from an external source (e.g., a host system). The controller 140 not only converts image data input from an external source into a data signal format readable by the data driver 120 before outputting the converted image data, but also generates a variety of control signals by receiving a variety of timing signals, including a Vsync signal, an Hsync signal, an input DE signal, and a clock signal, and outputs the variety of control signals to the data driver 120 and the gate driver 130 to control the data driver 120 and the gate driver 130. For example, the controller 140 may output a variety of gate control signals (GCSs), including a gate start pulse (GSP), a gate shift clock (GSC), and a gate output enable (GOE) signal, to control the gate driver circuit 130.

Here, the GSP controls the operation start timing of one or more GIP circuits (e.g., GDICs) of the gate driver 130. The GSP is a clock signal commonly input to one or more GIP circuits to control the shift timing of a scanning signal (or a gate pulse). The GOE signal designates timing information of one or more GIP circuits.

In addition, the controller 140 outputs a variety of data control signals (DCSs), including a source start pulse (SSP), a source sampling clock (SSC), and a source output enable (SOE) signal, to control the data driver 120. Here, the SSP controls the data sampling start timing of one or more SDICs of the data driver 120. The SSC is a clock signal controlling the data sampling timing of each of the SDICs. The SOE signal controls the output timing of the data driver 120.

As shown in FIG. 1, the controller 140 may be disposed on a control printed circuit board (CPCB) connected to the SPCBs, to which the SCICs are bonded, via a flexible flat cable (FFC), a flexible printed circuit (FPC), or the like. A power controller (not shown) may be further disposed on the CPCB. The power controller supplies a variety of voltages or currents to the display panel 110, the data driver 120, the gate driver 130, and the like, and controls the voltages or currents to be supplied. The power controller is also referred to as a power management IC. The SPCBs and the CPCB, as described, may be embodied as a single PCB.

Each of the subpixels SP disposed in the display panel 110 of the organic light-emitting display device 100 according to exemplary embodiments may include circuit elements, such as an organic light-emitting diode (OLED), two or more transistors, and one or more capacitors. The types and number of the circuit elements of each subpixel may be determined variously depending on the function that the subpixels provide and the design of the subpixels.

In the display panel 110 according to exemplary embodiments, each subpixel may be embodied as a circuit structure that compensates for characteristics of the subpixel, such as characteristics (e.g., a threshold voltage) of an OLED and characteristics (e.g., a threshold voltage or mobility) of a driving transistor that drives the OLED.

As shown in FIG. 2, each subpixel SP may be connected to a single data line DL and receives a single scanning signal SCAN through a single gate line GL. The subpixel includes an OLED, a driving transistor DT, a first transistor T1, a second transistor T2, a storage capacitor Cst, and the like. Because each subpixel includes the three transistors DT, T1, and T3 as well as the single storage capacitor Cst as described above, each subpixel is referred to as having a three-transistor one-capacitor (3T1C) structure.

In each subpixel, the driving transistor DT has a driving voltage EVDD applied thereto through a driving voltage line DVL, and is controlled by a voltage (e.g., a data voltage) of a gate node N2, applied through the second transistor T2, to drive the OLED. EVSS illustrated in FIG. 2 indicates a base voltage.

The driving transistor DT has a first node N1, a second node N2, and a third node N3. The first node N1 is connected to the first transistor T1, the second node N2 is connected to the second transistor T2, and the third node N3 receives the driving voltage EVDD. For example, in the driving transistor DT, the first node N1 may be a source node (also referred to as a "source electrode"), the second node N2 may be a gate node (also referred to as a "gate electrode"), and the third node N3 may be a drain node (also referred to as a "drain electrode"). The first node, the second node, and the third node of the driving transistor DT may change, depending on changes in the type, circuit, or the like of the transistor.

In addition, the first transistor T1 is controlled by the scanning signal SCAN supplied through the gate line GL, and is connected between a reference voltage line RVL, through which a reference voltage Vref is supplied, or a connection pattern (CP) connected to the reference voltage line RVL and the first node N1 of the driving transistor DT. The first transistor may also be referred to as a "sensor transistor."

Further, the second transistor T2 is controlled by the scanning signal SCAN commonly provided through the gate line GL, and is connected between the data line DL and the second node N2 of the driving transistor DT. The second transistor T2 is also referred to as a "switching transistor."

Also, the storage capacitor Cst is connected between the first node N1 and the second node N2 of the driving transistor DT to maintain a data voltage during a single frame.

As described above, the first transistor T1 and the second transistor T2 are controlled by a single scanning signal provided through a single gate line (e.g., a common gate line). Because each subpixel uses a single scanning signal as described above, each subpixel according to exemplary embodiments is referred to as having a "3T1C-based 1-scan structure" as a basic subpixel structure.

However, the present disclosure is not limited thereto. For example, a gate line and a sensing line may be connected to the first transistor T1 and the second transistor T2, respectively. This structure is referred to as a "3T1C-based 2-scan structure."

The subpixel structure of the organic light-emitting display device 100 according to exemplary embodiments may also include a "signal line connection structure" regarding the connection of each subpixel to a variety of signal lines, such as a data lines DL, a gate line GL, a driving voltage line DVL, and a reference voltage line RVL, in addition to the basic subpixel structure (3T1C-based 1-scan structure). Here, the signal lines further include the data lines DL, through which voltages are supplied to the subpixels, the gate lines GL, through which a scanning signal is provided to the subpixels, the reference voltage lines RVL, through which a reference voltage Vref is supplied to the subpixels, and the driving voltage lines DVL, through which a driving voltage EVDD is supplied to the subpixels.

The reference voltage lines RVL and the driving voltage lines DVL as described above are arranged parallel to the data lines DL. Either the number of the reference voltage lines RVL or the number of the driving voltage lines DVL may be equal to or smaller than the number of the data lines DL. When either the number of the reference voltage lines RVL or the number of the driving voltage lines DVL is smaller than the number of the data lines DL, some of the subpixels may be directly connected to the corresponding driving voltage lines DVL and the corresponding reference voltage lines RVL, while the remaining subpixels may be connected to the corresponding driving voltage lines DVL and the corresponding reference voltage lines RVL via a connection pattern (CP) instead of being directly connected thereto.

In addition, in the subpixels disposed in the organic light-emitting display device 100 according to exemplary embodiments, a red (R) subpixel, a white (W) subpixel, a blue (B) subpixel, and a green (G) subpixel may be sequentially arranged to form a single pixel. However, the present disclosure is not limited thereto, and the sequence of the red (R), white (W), blue (B), and green (G) subpixels may be changed variously.

Although the transistors DT, T1, and T2 are illustrated and described as being N-type transistors in the specification and drawings, this is merely for the sake of explanation. Rather, all of the transistors DT, T1, and T2 may be P-type transistors. Also, at least one of the transistors DT, T1, and T2 may be an N-type transistor, while the remaining transistors may be P-type transistors. Further, the OLED may be an inverted OLED. The transistors DT, T1, and T2 described herein are referred to as thin-film transistors (TFTs).

Figure 3:
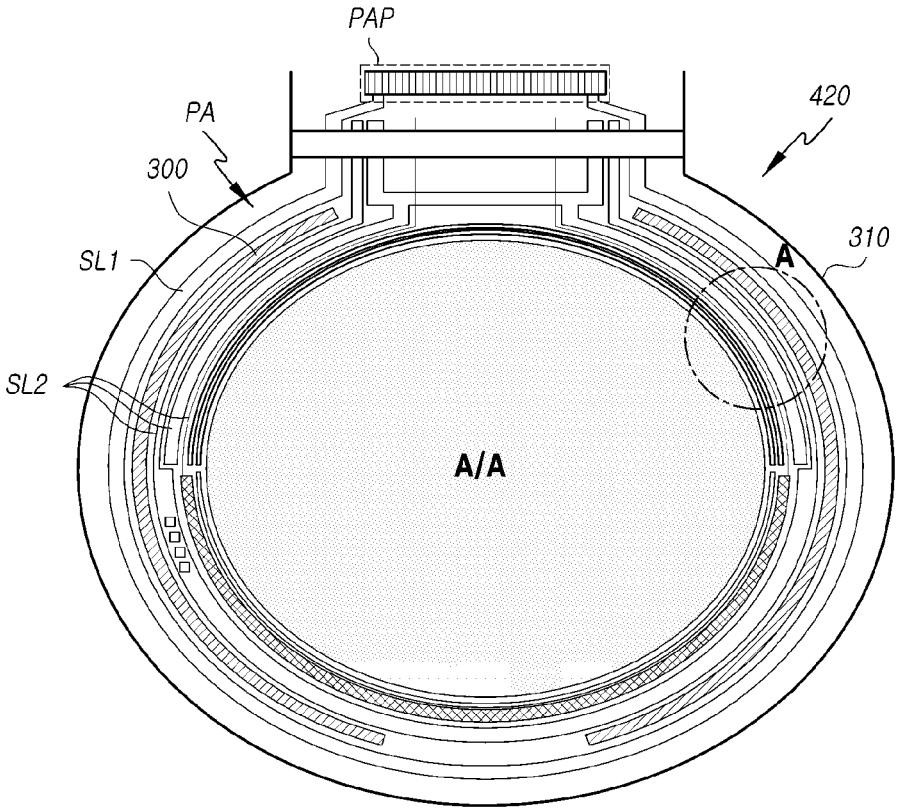
FIG. 3 is a view illustrating the structure of a rounded display device according to exemplary embodiments.

FIG. 3 illustrates the structure of a rounded display device according to exemplary embodiments.

With reference to FIG. 3, the rounded display device 420 according to exemplary embodiments may have a circular structure or an elliptical structure. Although the display panel 110 illustrated in FIG. 1 has a quadrangular structure, when the display device 420 is a rounded display device, such as a watch, a rounded display panel 310 having a predetermined curvature may be used therein.

The rounded display panel 310 according to exemplary embodiments may have a predetermined curvature along the circumference. For example, the rounded display panel 310 according to exemplary embodiments may be a circular display panel, in which the outer circumferential portions of the display panel are equidistant from the center of the active area A/A, or an elliptical display panel, in which the length of the major axis differs from the length of the minor axis.

A plurality of subpixels, as illustrated in FIG. 1, is disposed in an active area A/A of the rounded display panel 310. A pad portion PAP and a pad area PA are provided along the outer periphery of the active area A/A. The pad portion PAP includes a plurality of pads, and signal lines SL1 and SL2 are disposed in the pad portion PAP.

As illustrated in FIG. 3, when the active area A/A is circular, signal lines SL1 and SL2 disposed in the pad area PA have a circular shape to surround the active area A/A. When the rounded display device 420 has a GIP structure, a gate driver 300 also has a rounded structure. A plurality of GIP circuits is disposed within the gate driver 300. Each of the GIP circuits includes a plurality of transistors embodying a shift register, a level shifter, and the like.

As illustrated in FIG. 3, for example, first signal lines SL1 and second signal lines SL2 may be disposed in the pad area PA of the rounded display panel 310. The first signal lines SL1 and the second signals SL2 are a plurality of signal lines. When the display device according to exemplary embodiments are an organic light-emitting display device, the signal lines may include lines, through which clock signals are provided, and lines, through which signals are input to and output from the gate driver 300. Multiplexers and switching circuits for auto-probe inspection may be provided on the signal lines.

Figure 4:
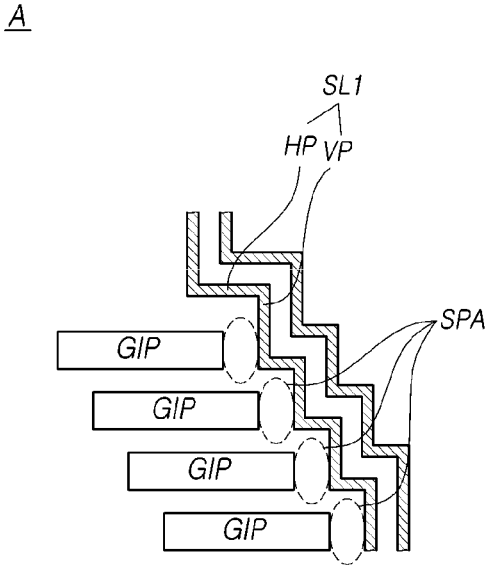
FIG. 4 is an enlarged view of area A of FIG. 3 illustrating the rounded display device according to exemplary embodiments.

FIG. 4 is an enlarged view illustrating the area A of the rounded display device according to exemplary embodiments.

As shown in FIG. 4, in the area A of the rounded display device 420 according to exemplary embodiments, the signal lines SL1 and SL2 and the GIP circuits GIP of the gate driver are arranged along the circular active area A/A. The first signal lines SL1 include a plurality of bent portions, e.g., a plurality of horizontal portions HP and a plurality of vertical portions VP alternating with the plurality of horizontal portions HP, the plurality of vertical portions VP and the plurality of horizontal portions HP being arranged along the curve of the active area A/A. Thus, the first signal lines SL1 have a stepped shape along the curve of the active area A/A.

In addition, the GIP circuits GIP of the gate driver are sequentially arranged in the vertical direction and are sequentially shifted in the horizontal direction such that predetermined portions thereof overlap each other in the vertical direction. That is, the GIP circuits GIP are arranged to have a stepped shape.

Thus, each of the GIP circuits of the gate driver is disposed to face the vertical portion VP of the adjacent first signal line SL1. However, when the GIP circuits are disposed and the first signal lines SL1 have the stepped shape as described above, there is a problem in that spaces SPA are formed between the vertical portions VP of the first signal lines SL1 and the GIP circuits GIP of the gate driver. When the spaces SPA are formed between the GIP circuits GIP and the first signal lines SL1, electric fields are applied from the first signal lines SL1 to the GIP circuits GIP, thereby deteriorating the transistors of the GIP circuits.

Figure 5:
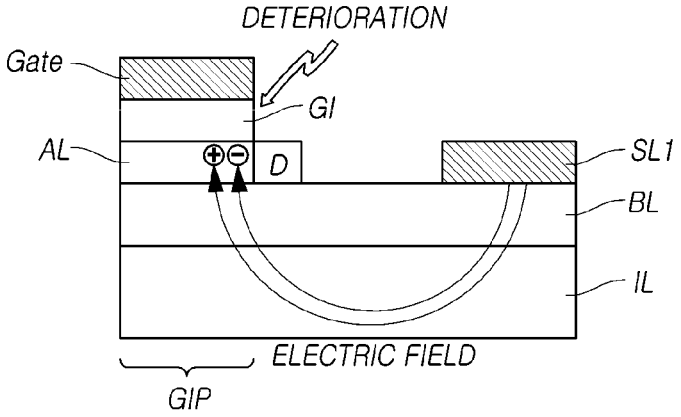
FIG. 5 is a schematic view illustrating deterioration occurring in the gate driver of the rounded display device.

FIG. 5 is a schematic view illustrating deterioration occurring in the gate driver of the rounded display device.

As illustrated in FIG. 5, each of the GIP circuits GIP of the gate driver includes a shift register, a level shifter, and the like, which are implemented as transistors. In the cross-section of the transistor of the GIP circuit GIP, a buffer layer BL is disposed on an insulating layer IL, and an active layer AL, a source/drain electrode D, a gate insulating layer GI, and a gate electrode Gate are stacked on the buffer layer BL. In addition, a first signal line SL1 is disposed in an area adjacent to the transistor. When an electric field is applied between the first signal line SL1 and the transistor, holes h and electrons e pass through the insulating layer IL made of polyimide.

The holes h and the electrons e form ions, which strike the active layer AL of the transistor, and are recombined within the active layer AL, thereby deteriorating the transistor.

The deterioration of the transistors in the GIP circuits GIP of the gate driver reduces the reliability of circuit elements, thereby distorting scanning signals output by the gate driver. The distorted scanning signals reduce the quality of displayed images.

The rounded display device according to exemplary embodiments has dummy GIP circuits disposed between the GIP circuits of the gate driver and the adjacent signal lines to block electric fields created between the signal lines and the GIP circuits. In addition, the rounded display device according to exemplary embodiments has the dummy GIP circuits disposed between the GIP circuits of the gate driver and the adjacent signal lines to prevent the transistors of the GIP circuits from deteriorating, thereby improving the reliability of circuit elements.

Figure 6:
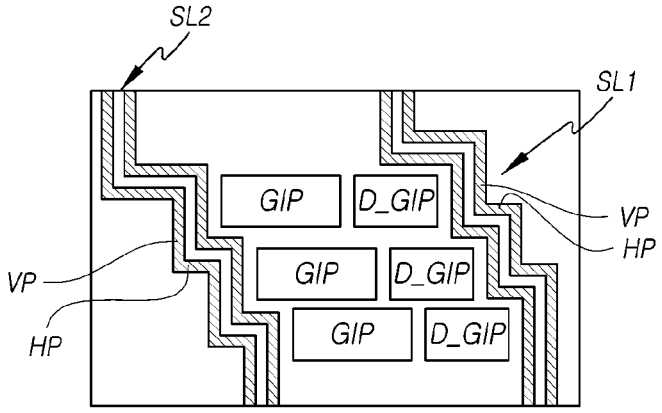
FIG. 6 is a view illustrating a gate driver structure of the rounded display device according to exemplary embodiments.
Figure 7:
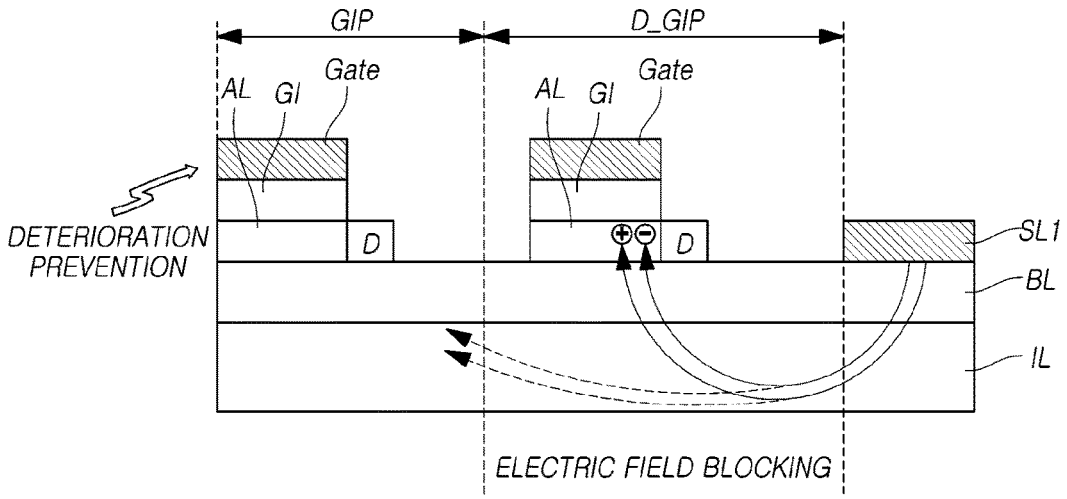
FIG. 7 is a cross-sectional view illustrating a process of protecting gate-in-panel (GIP) circuits of the gate driver using dummy GIP circuits in the gate driver of the rounded display device according to exemplary embodiments.

FIG. 6 illustrates a gate driver structure of the rounded display device according to exemplary embodiments, and FIG. 7 illustrates a process of protecting the GIP circuits of the gate driver using the dummy GIP circuits in the gate driver of the rounded display device according to exemplary embodiments.

As shown in FIGS. 6 and 7, the rounded display device according to exemplary embodiments may include GIP circuits GIP disposed in a gate driver area, as well as first signal lines SL1 and second signal lines SL2 disposed on both sides of a gate driver. Because the signal lines disposed in the rounded display device may be rounded along the circular active area, each of the first signal lines SL1 and the second signal lines SL2 has a bent structure including a plurality of vertical portions VP and a plurality of horizontal portions HP alternating with the plurality of vertical portions VP. That is, the first signal lines SL1 and the second signal lines SL2 have a stepped shape.

In addition, the rounded display device according to exemplary embodiments further has a plurality of dummy GIP circuits D_GIP disposed between the gate driver and the first signal lines SL1 to prevent the gate driver from deteriorating. Further, the plurality of dummy GIP circuits D_GIP are disposed adjacent to the GIP circuits GIP, respectively, in a similar manner in which the GIP circuits GIP of the gate driver are arranged (as described with reference to FIG. 4). Here, the dummy GIP circuits D_GIP are sequentially arranged in the vertical direction. Moreover, the dummy GIP circuits D_GIP are shifted in the horizontal direction such that predetermined portions thereof overlap each other in the vertical direction. That is, the dummy GIP circuits D_GIP are also arranged in a stepped shape.

As illustrated in the drawings, each of the dummy GIP circuits D_GIP is disposed adjacent to the corresponding GIP circuit GIP in the horizontal direction and faces the vertical portions of the first signal lines SL1. Although not shown in the drawings, the dummy GIP circuits D_GIP may be disposed between the gate driver and the second signal lines SL2 in the same manner in which the dummy GIP circuits D_GIP are disposed adjacent to the first signal lines SL1.

As illustrated in FIG. 7, the dummy GIP circuits D_GIP are disposed between the first signal lines SL1 and the GIP circuits GIP. Electric fields generated by the first signal lines SL1 are blocked by the dummy GIP circuits D_GIP instead of being applied to the GIP circuits GIP. Thus, recombination of holes h and electrons e occurs in the transistors of the dummy GIP circuits D_GIP, so that the GIP circuits GIP of the gate driver are prevented from deteriorating. This can consequently prevent the transistors of the gate driver from being deteriorated by electric fields generated by the first signal lines, thereby improving the reliability of the GIP circuits of the gate driver.

As illustrated in FIG. 7, the holes h and the electrons e extracted by the electric fields generated by the first signal lines SL1 are recombined in the transistors of the dummy GIP circuits D_GIP so that neither the holes h nor the electrons e are introduced into the transistors of the GIP circuits GIP.

Accordingly, the rounded display device according to exemplary embodiments has the dummy GIP circuits disposed between the GIP circuits of the gate driver and the adjacent signal lines to block electric fields between the signal lines and the GIP circuits. In addition, the rounded display device according to exemplary embodiments has the dummy GIP circuits disposed between the GIP circuits of the gate driver and the signal lines to prevent the transistors of the GIP circuits from deteriorating, thereby improving the reliability of circuit elements.

Figure 8:
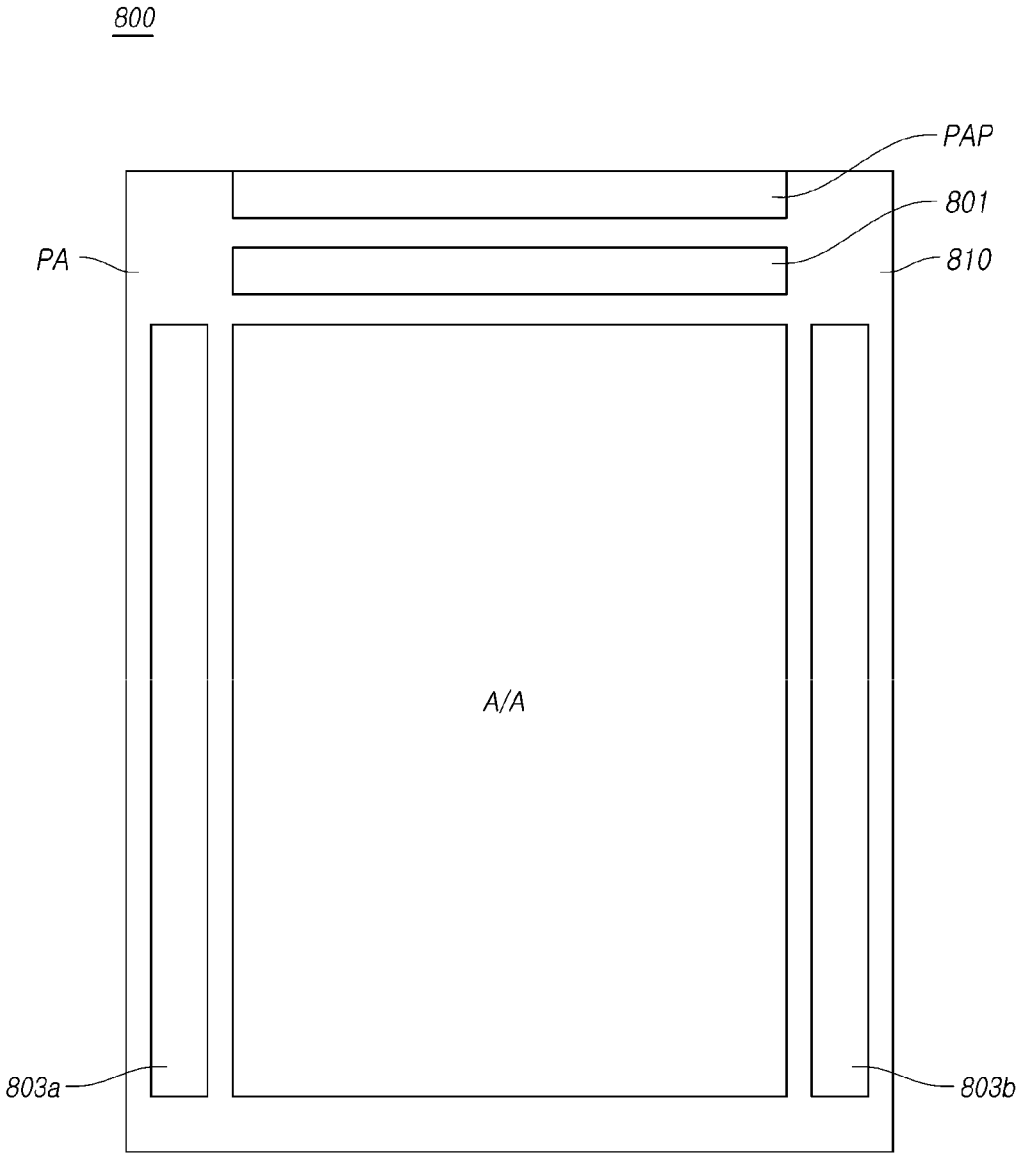
FIG. 8 is a schematic view illustrating the structure of another display device according to exemplary embodiments.

FIG. 8 is a schematic view illustrating the structure of another display device according to exemplary embodiments.

As shown in FIG. 8, the display device 800 according to exemplary embodiments may include a display panel 810 having an active area A/A and a pad area PA. A plurality of subpixels is disposed in the active area A/A of the display panel 810. A pad portion PAP in which a plurality of pads are disposed, a first gate driver 803*a*, a second gate driver 803*b*, and a data driver 801 are disposed in the pad area PA. The display device according to exemplary embodiments may have a GIP structure in which the first gate driver 803*a* and the second gate driver 803*b* are mounted on the display panel 810.

The display device according to exemplary embodiments may be an organic light-emitting display device. Each of subpixels may have a 3T1C structure, as illustrated in FIG. 2, or may have one structure selected from among a 4T1C structure, a 5T1C structure, and a 5T2C structure, as illustrated in FIGS. 9 to 11.

Figure 9:
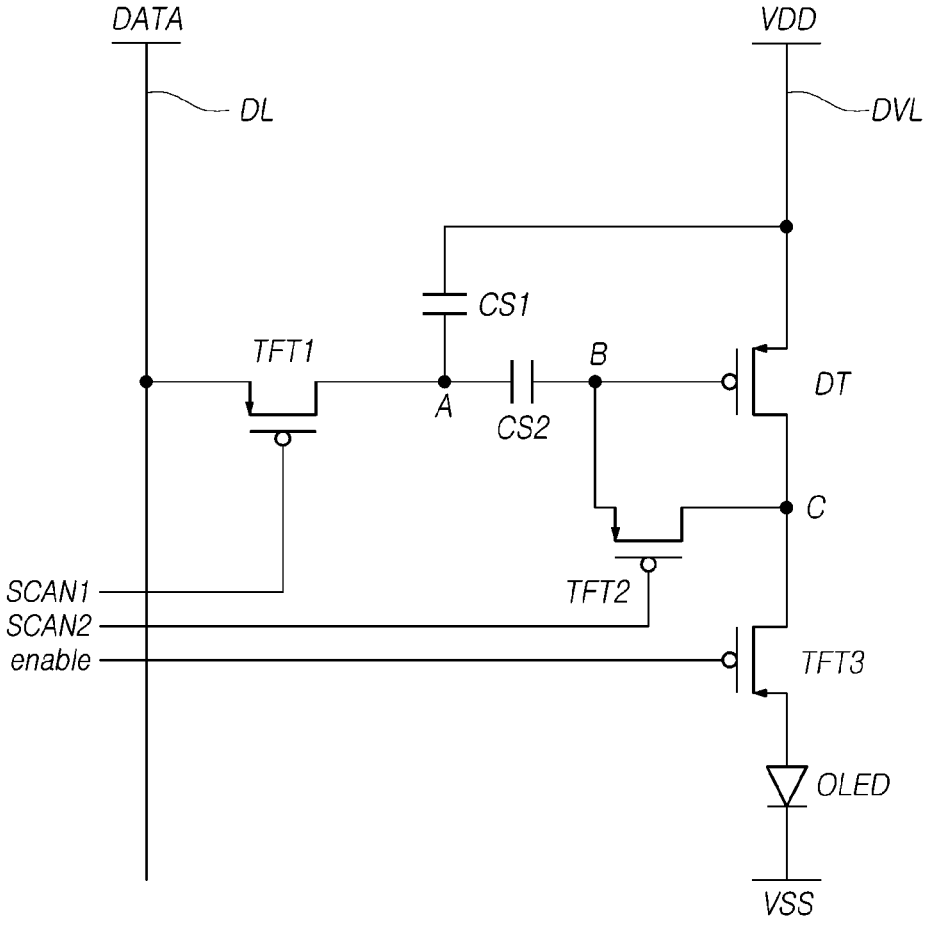
FIGS. 9 to 11 are circuit diagrams illustrating a variety of equivalent circuits of subpixels of the display device illustrated in FIG. 8.
Figure 10:
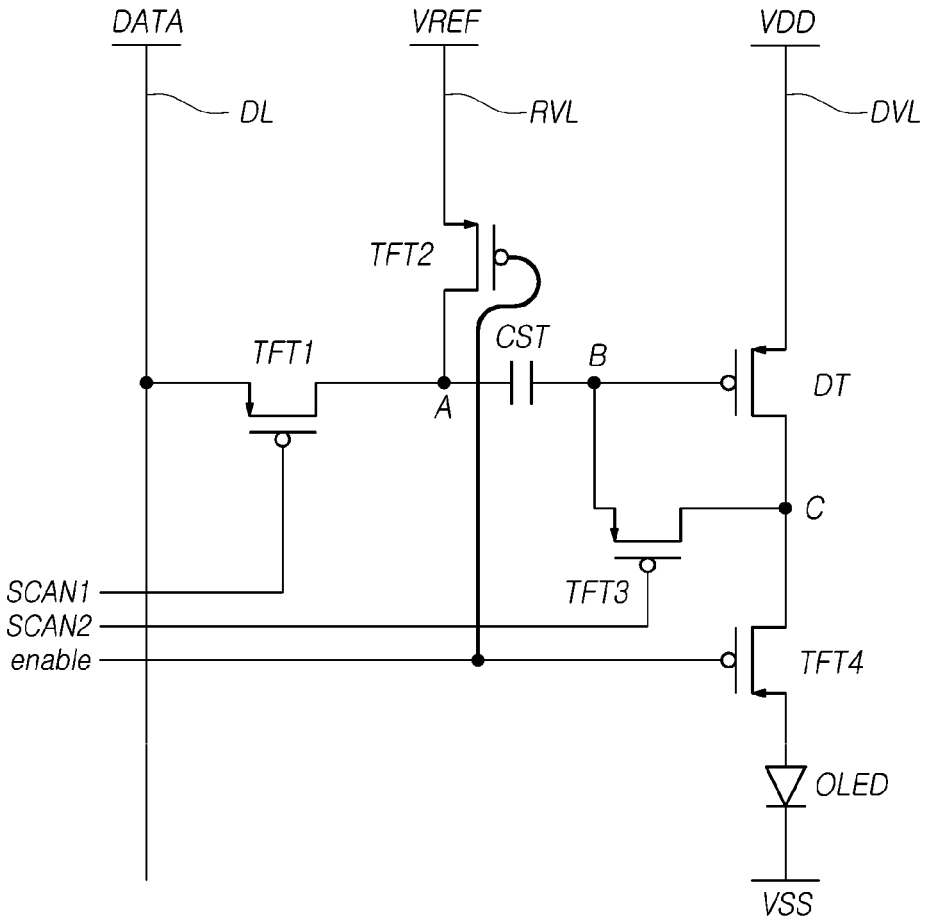
Figure 11:
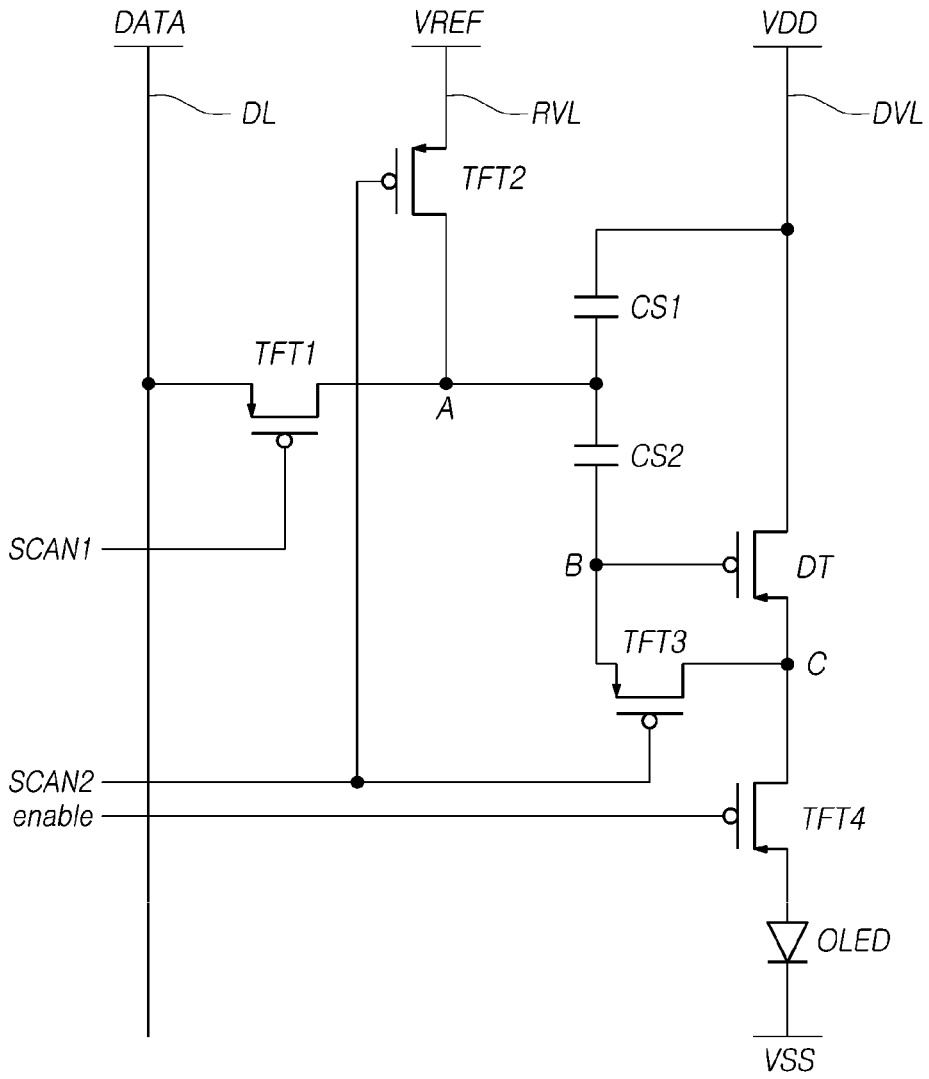

FIGS. 9 to 11 are circuit diagrams illustrating a variety of equivalent circuits of subpixels of the display device illustrated in FIG. 8.

As shown in FIG. 9, each of the subpixels of the display device according to exemplary embodiments may have a 5T2C structure. Each subpixel includes: a first transistor TFT1 having a gate connected to a first scanning line (or a first gate line) SCAN1, with one end thereof being connected to a data line DL, and the other end thereof being connected to a first node A; a first capacitor CS1 connected between the first node A and a driving voltage line DVL; a second capacitor CS2 connected between the first node A and a second node B; a driving transistor DT having a gate connected to the second node B, with one end thereof being connected to the driving voltage line DVL, and the other end thereof being connected to a third node C; a second transistor TFT2 having a gate connected to a second scanning line (or a second gate line) SCAN2, with one end thereof being connected to the second node B, and the other end thereof being connected to the third node C; a third transistor TFT3 having a gate connected to an enable line Enable, with one end thereof being connected to the third node C; and an OLED having a first electrode connected to the other end of the third transistor TFT3 and a second electrode connected to a base voltage line VSS.

The first transistor TFT1 is turned on by a first scanning signal provided through the first scanning line (or the first gate line) SCAN1, and delivers a data signal provided through the data line DL. The first capacitor CS1 maintains a voltage, e.g., a difference between a voltage supplied through the driving voltage line DVL and a voltage supplied through the first transistor TFT1.

The second capacitor CS2 stores a data signal provided through the first transistor TFT1 and a data signal caused by the voltage maintained by the first capacitor CS1. The second transistor TFT2 is turned on by a second scanning signal provided through the second scanning line (or the second gate line) SCAN2, and controls the threshold voltage of the driving transistor DT. The driving transistor DT operates in response to the data signal stored in the second capacitor CS2. The third transistor TFT3 is turned on by an enable signal provided through the enable line Enable, and controls current flowing through the driving transistor DT. When the driving transistor DT operates and the third transistor TFT3 is turned on, the OLED generates light in response to current supplied through the driving voltage line DVL.

As shown in FIG. 10, each of the subpixels of the display device according to exemplary embodiments may have a 5T1C structure. Each subpixel includes: a first transistor TFT1 having a gate connected to a first scanning line SCAN1, with one end thereof being connected to a data line DL, and the other end thereof being connected to a first node A; a capacitor CST connected between the first node A and a second node B; a driving transistor DT having a gate connected to the second node B, with one end thereof being connected to a driving voltage line DVL, and the other end thereof being connected to a third node C; a second transistor TFT2 having a gate connected to an enable line Enable, with one end thereof being connected to the first node A, and the other end thereof being connected to a reference voltage line RVL; a third transistor TFT3 having a gate connected to a second scanning line SCAN2, with one end thereof being connected to the second node B, and the other end thereof being connected to the third node C; a fourth transistor TFT4 having a gate connected to the enable line Enable, with one end thereof being connected to the third node C; and an OLED having a first electrode connected to the other end of the fourth transistor TFT4 and a second electrode connected a base voltage line VSS.

As shown in FIG. 11, each of the subpixels of the display device according to exemplary embodiments may have a 5T2C structure. Each subpixel includes: a first transistor TFT1 having a gate connected to a first scanning line SCAN1, with one end thereof being connected to a data line DL, and the other end thereof being connected to a first node A; a first capacitor CS1 connected between the first node A and a driving voltage line DVL; a second capacitor CS2 connected between the first node A and a second node B; a second transistor TFT2 having a gate connected to a second scanning line SCAN2, with one end thereof being connected to a reference voltage line RVL, and the other end thereof being connected to the first node A; a driving transistor DT having a gate connected to the second node B, with one end thereof being connected to a driving voltage line DVL, and the other end thereof being connected to a third node C; a third transistor TFT3 having a gate connected to a second scanning line SCAN2, with one end thereof being connected to the second node B, and the other end thereof being connected to the third node C; a fourth transistor TFT4 having a gate connected to an enable line Enable, with one end thereof being connected to the third node C; and an OLED having a first electrode connected to the other end of the fourth transistor TFT4 and a second electrode connected a base voltage line VSS.

When the subpixels of the display devices according to exemplary embodiments have the 4T1C, 5T1C, and 5T2C structures, enable signals are provided to control the on/off of the transistors connected to the OLEDs. The enable signals may be provided by an enable circuit, which is integrated with the gate driver or is separated from the gate driver.

Figure 12:
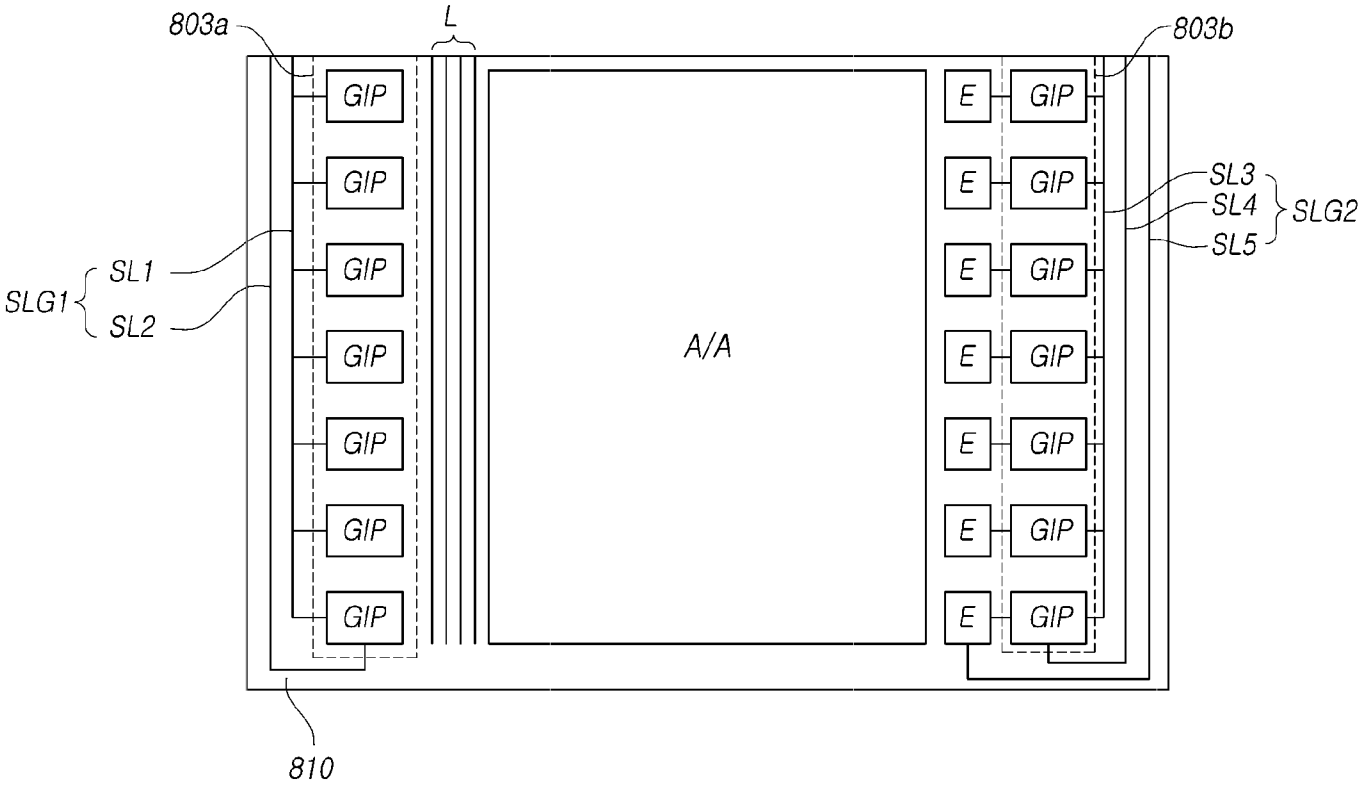
FIG. 12 is a schematic diagram illustrating a configuration of signal lines in the gate driver areas of the display device according to exemplary embodiments.
Figure 13:
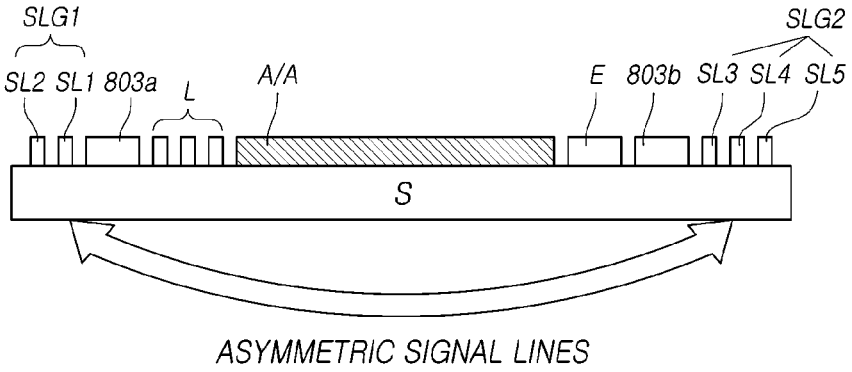
FIG. 13 is a cross-sectional view illustrating the gate driver areas of the display device according to exemplary embodiments in which signal lines are arranged asymmetrically.

FIG. 12 is a schematic view illustrating a configuration of signal lines in the gate driver areas of the display device according to exemplary embodiments, and FIG. 13 is a cross-sectional view illustrating the gate driver areas of the display device according to exemplary embodiments in which signal lines are arranged asymmetrically.

In FIGS. 12 and 13, the first gate driver 803*a* and the second gate driver 803*b* are disposed in the display panel 810 of the display device 800 according to exemplary embodiments. A plurality of GIP circuits GIP is disposed within the first gate driver 803*a* and the second gate driver 803*b*. Each of the GIP circuits GIP includes a shift register and a level shifter. In addition, separate from the second gate driver 803*b*, enable circuits E for providing enable signals are disposed.

First to fifth signal lines SL1, SL2, SL3, SL4, and SL5 are disposed in the areas outside of the first gate driver 803*a* and the second gate driver 803*b*. A first signal line group SLG1 having the first and second signal lines SL1 and SL2 is disposed outside of the first gate driver 803*a*, while a second signal line group SLG2 having the third to fifth signal lines SL3, SL4, and SL5 is disposed outside of the second gate driver 803*b*.

The first to fifth signal lines SL1, SL2, SL3, SL4, and SL5 may be signal lines, through which signals are provided to inspect the states of the GIP circuits GIP of the first and second gate drivers 803*a* and 803*b*, through which start pulses are provided to the GIP circuits GIP, or which monitor the enable circuits E and scanning signals output by the gate drivers 803*a* and 803*b*. A reference numeral L indicates signal lines, through which a clock signal is provided, or signal lines, through which a reference voltage or a driving voltage is supplied when the display device is an organic light-emitting display device.

As illustrated in FIG. 13, the first signal line group SLG1 and the second signal line group SLG2 are disposed on the left and right peripheries of a substrate S, on both sides of the active area A/A on the substrate S. However, because the first and second signal lines SL1 and SL2 are disposed in the first signal line group SLG1 and the third to fifth signal lines SL3 to SL5 are disposed in the second signal line group SLG2, the numbers of the signal lines in the signal line groups are asymmetric.

When the signal lines are arranged asymmetrically as described above, the capacitance and influence on signals between the first signal line group SLG1 and the first gate driver 803*a* differ from the capacitance and influence on signals between the second signal line group SLG2 and the second gate driver 803*b* so that quality defects occur. That is, electric fields or capacitance created between the first signal line group SLG1 and the transistors of the first gate driver 803*a* differ from electric fields or capacitance created between the second signal line group SLG2 and the second gate driver 803*b* such that scanning signals output by the gate drivers may be influenced differently.

The display device according to exemplary embodiments has the same number of signal lines disposed in the gate driver areas of the display panel to remove variations in scanning signals output by the gate driver, thereby improving the quality of displayed images.

Figure 14:
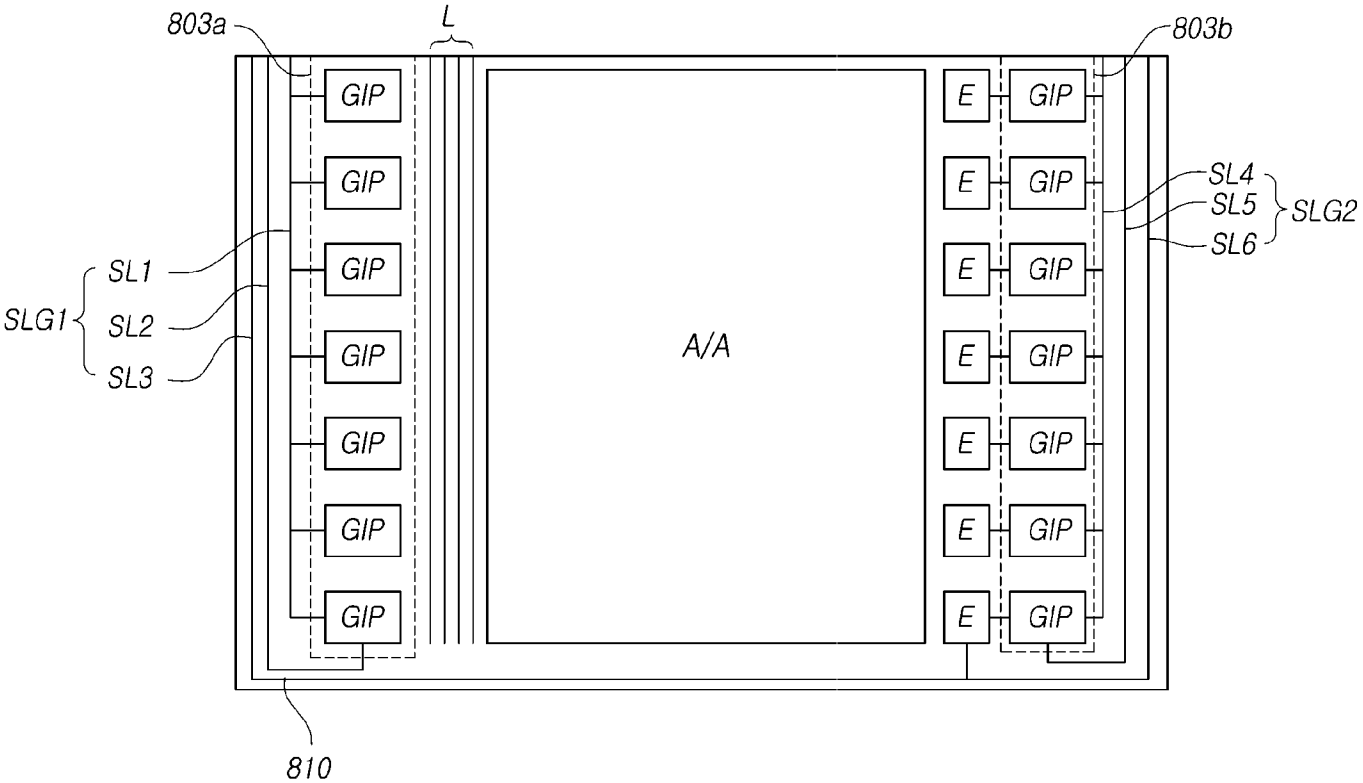
FIGS. 14 and 15 illustrate a configuration of signal lines in the gate driver areas of the display device according to exemplary embodiments, the signal lines being arranged symmetrically.
Figure 15:
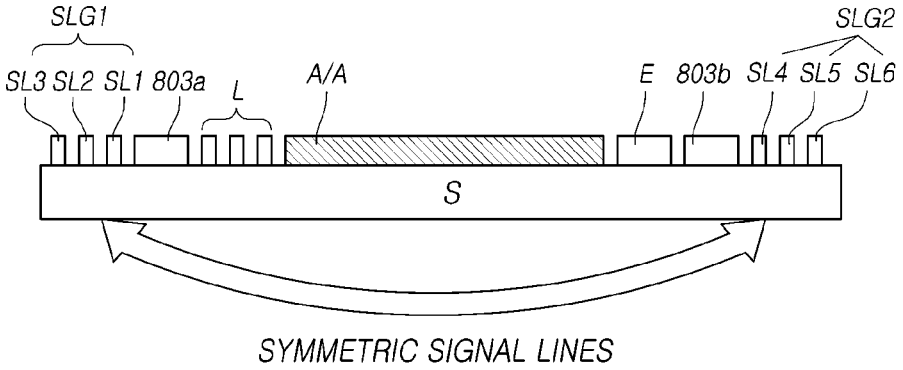

FIGS. 14 and 15 illustrate a configuration of signal lines in the gate driver areas of the display device according to exemplary embodiments, the signal lines being arranged symmetrically.

In FIGS. 14 and 15, the first gate driver 803*a* and the second gate driver 803*b* are disposed on the display panel 810 of the display device 800 according to exemplary embodiments. A plurality of GIP circuits GIP is disposed in the first gate driver 803*a* and the second gate driver 803*b*. Each of the GIP circuits GIP includes a shift register and a level shifter. In addition, separate from the second gate driver 803*b*, enable circuits E for providing enable signals are disposed. The enable signals are provided when the subpixels disposed in the display panel have one of the structures illustrated in FIGS. 9 to 11.

First to third signal lines SL1, SL2, and SL3 are disposed in the area outside of the first gate driver 803*a*, and fourth to sixth signal lines SL4, SL5, and SL6 are disposed in the area outside of the second gate driver 803*b*. That is, a first signal line group S1G1 having the first to third signal lines SL1, SL2, and SL3 is disposed outside of the first gate driver 803*a*, while a second signal line group S1G2 having the fourth to sixth signal lines SL4, SL5, and SL6 is disposed outside of the second gate driver 803*b*. One of the first to third signal lines SL1, SL2, SL3 of the first signal line group SLG1 may be a signal line extending from one of the fourth to sixth signal lines SL4, SL5, and SL6 of the second signal line group SLG2.

As illustrated in FIGS. 14 and 15, the sixth signal lines SL6 connected to the enable circuits E disposed in the area adjacent to the second gate driver 803*b* may be signal lines outputting the same signals as the third signal lines SL3 disposed in the area adjacent to the first gate driver 803*a*. That is, the sixth signal lines SL6 connected to the enable circuits E are branched from the bottoms of the enable circuits E to be adjacent to the second driver 803*b*, while the other signal lines branched from the enable circuits E form the third signal lines SL3 adjacent to the first gate driver 803*a*. Thus, the signals provided through the third signal lines SL3 may be the same as the signals provided through the sixth signal lines SL6.

As described above, in the display device according to exemplary embodiments, the number of signal lines disposed in the area of the first gate driver 803*a* is the same as the number of signal lines disposed in the area of the second gate driver area 803*b*. This can consequently minimize variations in the transistors of the first and second gate drivers, caused by the influences of the signal lines, thereby improving the quality of displayed images.

As illustrated in FIG. 15, the first signal line group SLG1 and the second signal line group SLG2 are disposed on the left and right peripheries of the substrate S, on both sides of the active area A/A on the substrate S.

Differently from FIG. 13, the first to third signal lines SL1, SL2, and SL3 are disposed in the first signal line group SLG1, while the fourth to sixth signal lines SL4, SL5, and SL6 are disposed in the second signal line group SLG2. Thus, the signal lines SL1, SL2, and SL3 of the first signal line group SLG1 are disposed symmetrical to the signal lines SL4, SL5, and SL6 of the second signal line group SLG2.

This consequently causes the capacitance or influence on signals between the first signal line group SLG1 and the transistors of the first gate driver 803*a* to be similar to or the same as the capacitance or influence on signals between the second signal line group SLG2 and the transistors of the second gate driver 803*b*.

When variations in the transistors caused by the influence on the first and second gate drivers 803*a* and 803*b* are reduced, variations in signals output by the gate drivers 803*a* and 803*b* can be reduced, thereby improving the quality of images displayed on the display panel. In the display device according to exemplary embodiments, the same number of signal lines is disposed in the areas of the gate drivers mounted on the display panel, thereby minimizing variations in the transistors of the gate drivers.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel including an active area having a plurality of subpixels and a pad area disposed along the active area;

a gate driver in the pad area of the display panel and having a plurality of segmented gate-in-panel circuits substantially arranged along a curve of the active area;

a first signal line outside of the gate driver;

a second signal line between the gate driver and the active area; and a plurality of segmented dummy gate-in-panel circuits adjacent to the plurality of gate-in-panel circuits, wherein each of the plurality of dummy gate-in-panel circuits is disposed adjacent to the corresponding each of the plurality of gate-in-panel circuits respectively.

2. The display device according to claim 1, wherein the plurality of dummy gate-in-panel circuits are between the first signal line and the gate driver or between the second signal line and the gate driver.

3. The display device according to claim 2, wherein the active area has a substantially rounded shape, and the gate driver and the first and second signal lines have substantially rounded structures along the curve of the active area.

4. The display device according to claim 3, wherein the plurality of gate-in-panel circuits are arranged such that portions thereof overlap each other in a vertical direction, and the plurality of dummy gate-in-panel circuits adjacent to the plurality of gate-in-panel circuits are arranged such that portions thereof overlap each other in a vertical direction.

5. The display device according to claim 3, wherein each of the first and second signal lines has a bent structure including a plurality of vertical portions and a plurality of horizontal portions alternating with the plurality of vertical portions.

6. The display device according to claim 5, wherein each of the plurality of dummy gate-in-panel circuits faces the vertical portions of the first signal line or the second signal line.

7. The display device according to claim 3, wherein each of the first and second signal lines has a stepped structure including a plurality of vertical portions and a plurality of horizontal portions alternating with the plurality of vertical portions.

8. The display device according to claim 7, wherein each of the plurality of dummy gate-in-panel circuits faces the vertical portions of the first signal line or the second signal line.

9. The display device according to claim 1, wherein each of the plurality of gate-in-panel circuits has a plurality of transistors including a shift register and a level shifter.

10. The display device according to claim 1, wherein each of the plurality of dummy gate-in-panel circuits has a plurality of transistors.

11. The display device according to claim 1, wherein the plurality of dummy gate-in-panel circuits shield an electric field from being applied to the plurality of gate-in-panel circuits from an area of the first signal line.

12. A display device, comprising:

a display panel including an active area having a plurality of subpixels and a pad area disposed along the active area;

a first gate driver and a second gate driver disposed in the pad area respectively located at opposing sides relative to the active area;

a first signal line group including one or more signal lines disposed in an area of the first gate driver;

a second signal line group including one or more signal lines disposed in an area of the second gate driver; and a plurality of enable circuits disposed in one of the areas of the first gate driver and the second gate driver, wherein the first signal line group and the second signal line group are symmetrical with respect to the active area, wherein a number of the signal lines of the first signal line group is equal to a number of the signal lines of the second signal line group.

13. The display device according to claim 12, wherein each of the plurality of subpixels includes an organic light-emitting diode.

14. The display device according to claim 12, further comprising a plurality of enable circuits in one of the areas of the first and second gate drivers to provide enable signals to the plurality of subpixels.

15. The display device according to claim 14, wherein each of the plurality of subpixels has one structure selected from among a structure having four transistors and a single capacitor, a structure having five transistors and a single capacitor, and a structure having five capacitors and two capacitors.

16. The display device according to claim 12, wherein a same signal is provided to one of the signal lines of the first signal line group and one of the signal lines of the second signal line group.

17. The display device according to claim 12, wherein one of the signal lines of the first signal line group and one of the signal lines of the second signal line group are branched from a single signal line.

18. The display device according to claim 1, wherein the plurality of dummy gate-in-panel circuits have substantially the same structures as the plurality of gate-in-panel circuits.

* * * * *